United States Patent [19]

Shols

[11] Patent Number: 4,886,298

[45] Date of Patent: Dec. 12, 1989

[54] ROLLER SKI

[76] Inventor: Christopher B. Shols, 3700 Lillick Dr., #315, Santa Clara, Calif. 95051

[21] Appl. No.: 126,584

[22] Filed: Nov. 30, 1987

[51] Int. Cl.[4] ..... A63C 1/00

[52] U.S. Cl. ..... 280/842; 280/87.042

[58] Field of Search ..... 280/11.1 BT, 11.1 R, 280/11.27, 11.28, 87.04 A

[56] References Cited

U.S. PATENT DOCUMENTS

| | | | |
|---|---|---|---|
| 1,745,992 | 2/1930 | Herold | 280/11.28 |
| 3,512,796 | 5/1970 | Mangus | 280/11.22 |
| 3,522,951 | 8/1970 | Tyson | 280/11.1 R |
| 3,545,779 | 12/1970 | Simms | 280/11.28 |
| 3,722,900 | 3/1973 | Dickert | 280/11.1 BT |
| 3,827,706 | 8/1974 | Milliman | 280/11.1 BT |
| 3,856,321 | 12/1974 | Solymosi | 280/87.04 A |
| 4,134,600 | 1/1979 | McDonald et al. | 280/11.1 BT |
| 4,353,566 | 10/1982 | Mohlenbrock | 280/11.1 BT |
| 4,460,187 | 7/1984 | Shimizu | 280/87.04 A |

*Primary Examiner*—Charles A. Marmor
*Assistant Examiner*—Eric Culbreth
*Attorney, Agent, or Firm*—Flehr, Hohbach, Test, Albritton & Herbert

[57] ABSTRACT

The present device is a roller ski that closely simulates the sliding, edging, turning and weighting characteristics of a snow ski. The roller ski is comprised of an exterior frame with pivotally mounted skate rollers that are inclinationally biased in the longitudinal direction to the ski and an interior platform which has a skateboard truck or similar rollers and which is pivotably hinged to the exterior frame along the longitudinal center line of the ski. The pivoting rollers on the exterior frame are attached to a caster mounted to a horizontal plate that is springily hinged to permit forced rotation about a horizontal transverse axis on the bottom side of the exterior frame to which the caster is attached. Consequently, weighting of the ski depresses the pivoting rollers, which are continuously in contact with the ski surface; whereas the rollers on either side of the skateboard truck make contact with the ski surface if the interior platform is tilted about the longitudinal center line of the ski. This particular combination of roller, hinge, platform and pivoting elements provide an effective simulation of conventional downhill snow skiing on a hard smooth surface such as cement pavement or blacktop.

12 Claims, 7 Drawing Sheets

ROLLER SKI

BACKGROUND OF THE INVENTION

The present invention relates generally to roller skis adapted to simulate the balance and motion characteristics of downhill snow skiing.

The present invention permits the use of roller or wheeled skis to learn and practice maneuvers that closely simulate those of downhill snow skiing. Devices in the prior art do not allow simulation of turning and sliding to the same degree as accomplished on snow skis. The extent to which a roller ski device resembles snow skiing depends on its ability to slide or sideslip, brake and turn in a way that allows these maneuvers to be done simultaneously.

Various land skis have skateboard-like rollers for the purpose of turning by tilting the ski. Other patents provide pivoting caster rollers or wheels to allow sliding. However, the combination of these two functional aspects in the prior art do not permit the user to accomplish controlled turning and sliding simultaneously when a turning maneuver simulates the edging aspect of a snow ski turn. For example, Milliman, U.S. Pat. No. 3,827,706 utilizes the caster wheel that provides limited turning ability in addition to sliding. In another instance, Shimizu, U.S. Pat. No. 4,460,187, provides a skateboard-like and caster wheel assembly to accomplish turning. However, in this case, the caster wheel does not bring about sliding while other wheels are also in contact with the ski surface.

Ball-type rollers are shown to allow sideslipping or sliding. Tyson, U.S. Pat. No. 3,522,951, provides multidirectional motion with limited control of turning by pivoting the ski on rollers and linear tracking in a longitudinal direction of the ski on a fixed wheel base in a very similar manner as does Milliman (cited above).

Other roller applications of land skiing involve the use of tapered wheels attached to a cambered snow ski as illustrated by Dickert, U.S. Pat. No. 3,722,900 and Mangus, U.S. Pat. No. 3,512,796. These devices allow turning by tilting and bowing of the ski; however, sliding cannot be accomplished to the same degree with a fixed roller or wheel as with a pivoting one.

SUMMARY OF THE INVENTION

Therefore, it is a primary objective of the present invention to provide a roller ski that simulates the balance and motion characteristics of conventional downhill snow skis.

Another objective of the invention is to provide a roller ski that allows simultaneous sliding and turning in response to the skier shifting body weight.

A third objective of the invention is to permit a pair of roller skis to be used in either a snow plow or parallel orientation so that users of various snow skiing ability can utilize the present invention.

To achieve the foregoing and other objects, and in accordance with the purpose of the present invention, a roller ski is formed of a frame and a platform that are pivotably mounted to each other along substantially aligned longitudinal axes. A binding is mounted to the platform for engaging a skier's foot. A plurality of pivoting rollers are attached to the frame for engaging the ground surface. A plurality of pivoting rollers attached to the platform are mounted for selective engagement with the ground so that a skier can control the ski by shifting body weight.

BRIEF DESCRIPTION OF THE DRAWINGS

The features of the present invention that are believed to be novel are set forth with particularity in the appended claims. The invention, together with further objects and advantages thereof, may best be understood by reference to the following description taken in conjunction with the accompanying drawings in which:

DETAILED DESCRIPTION OF ILLUSTRATIVE EMBODIMENTS

Figure 4B:
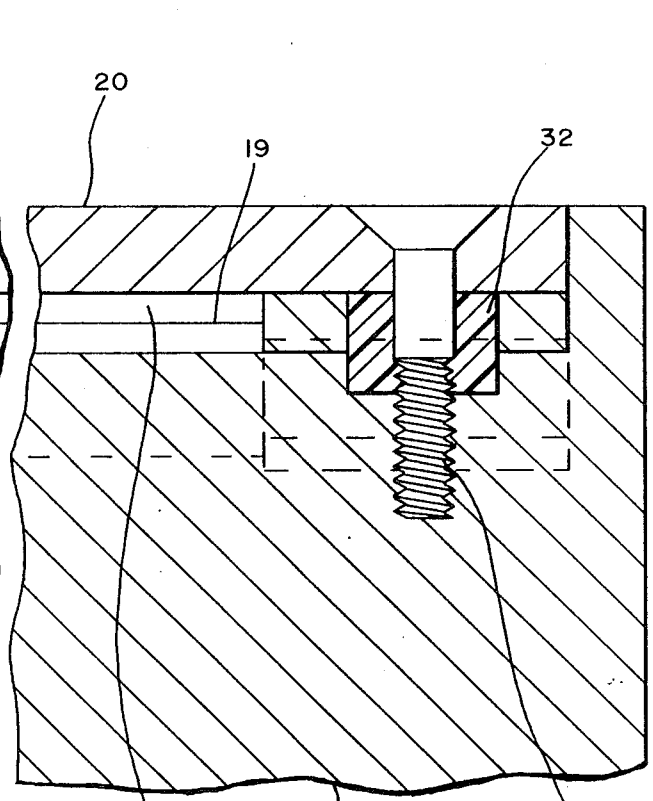
FIG. 4B is a cross sectional view of the attachment between the inner platform and outer frame taken along line 4B—4B as shown in FIG. 4C.
Figure 4A:
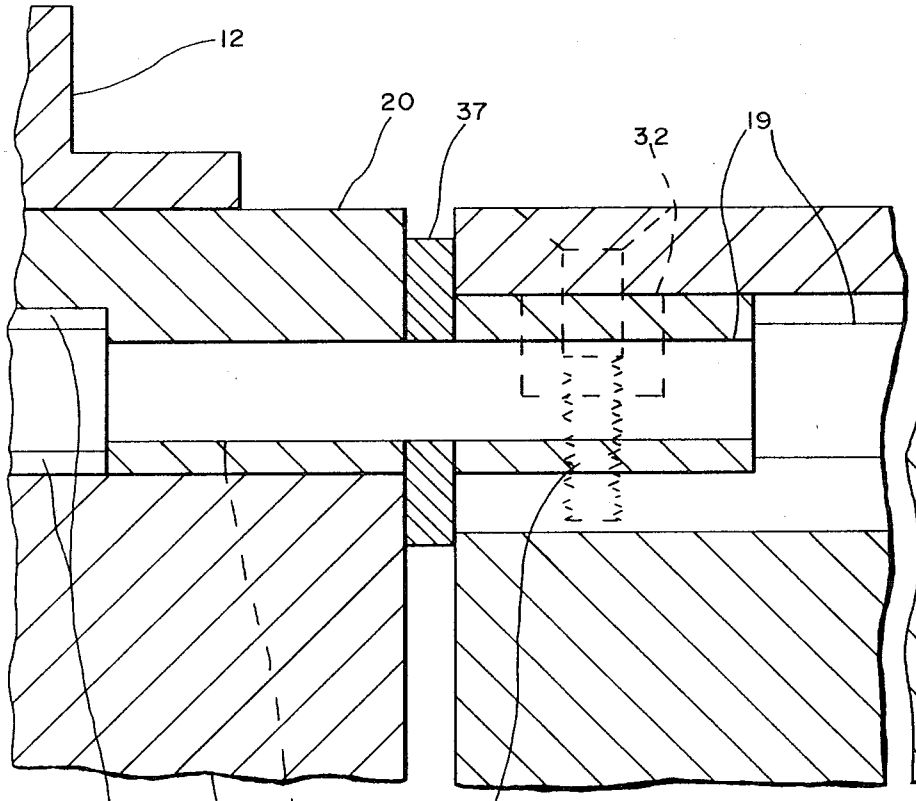
FIG. 4A is a cross sectional view of the attachment between the inner platform and outer frame taken along line 4A—4A as shown in FIG. 4C.
Figure 4C:
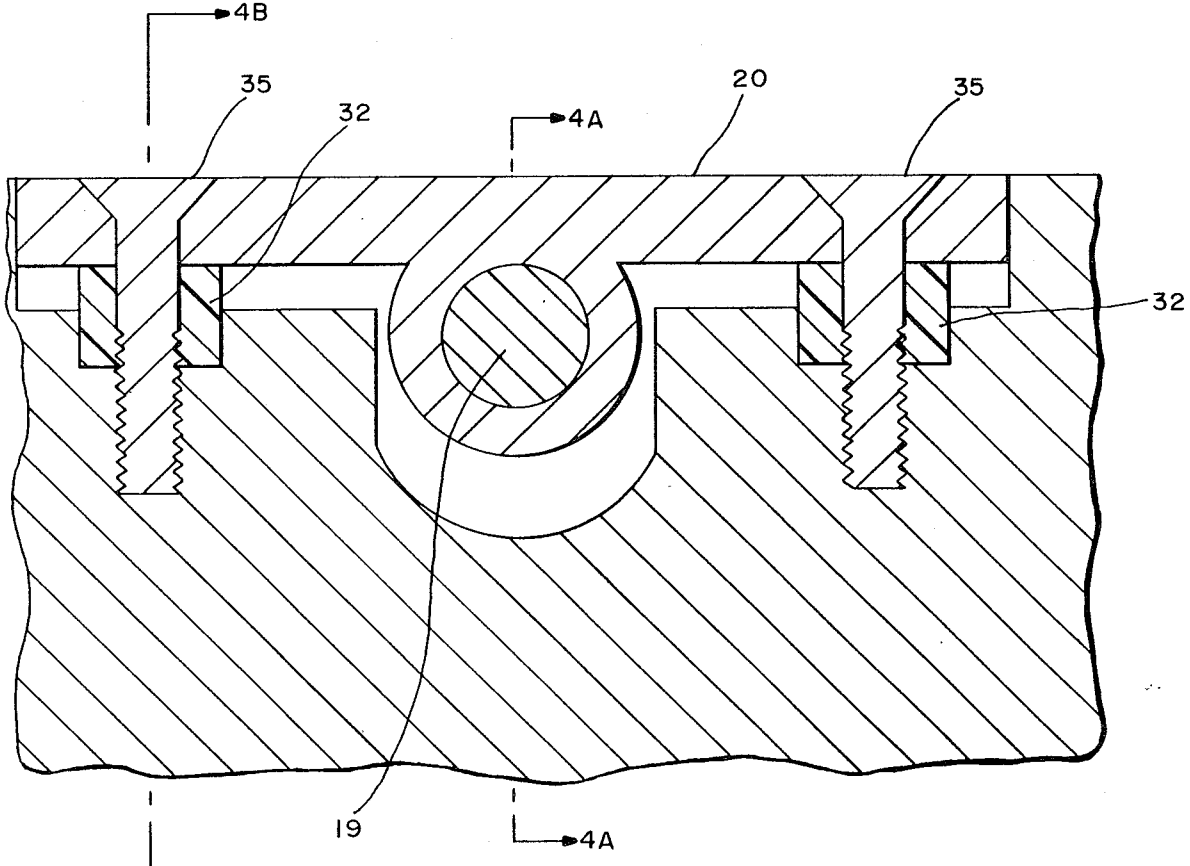
FIG. 4C is a cross sectional view of the fastening plate and outer frame as shown in FIG. 2.

With reference to the drawings, there are shown right and left skis 10, which are attached to ski boots of a skier by means of release bindings 12. Each ski 10 consists of an outer frame 13 and an inner platform 14 to which the ski boot is attached. The outer frame 13 is carried by a front and rear roller assembly 15, 16. The inner platform 14 is carried by another set of front and rear roller assemblies 17, 18 and attached to the outer frame 13 with a support rod 19 which is positioned along the longitudinal center line of the ski 10 and provides a rotational coupling between the outer frame 13 and inner platform 14. The support rod 19 is recessed into longitudinal grooves 33, 34 which pass along the longitudinal center line of the ski in outer frame 13 and inner platform 14 respectively. It is desirable to mount the support rod 19 below the upper surface of the outer frame and inner platform. The support rod 19 is secured to the outer frame 13 with hinge-like transverse fastening plates 20 and the inner platform 14 with fastening plates 20 underneath the ski bindings 12. The outer frame 13 and inner platform 14 are separated by a pair of washers 37 that fit snugly around the support rod 19 immediately in front of and behind the platform 14. The support rod 19 is housed in the fastening plates 20 that fit into the longitudinal grooves 33, 34 in a manner that prevents lateral movement of the support rod as shown in FIGS. 4A, 4B and 4C. Conventional ski bindings 12 may be used to secure conventional ski boots or light weight ski boots to the ski.

Figure 4D:
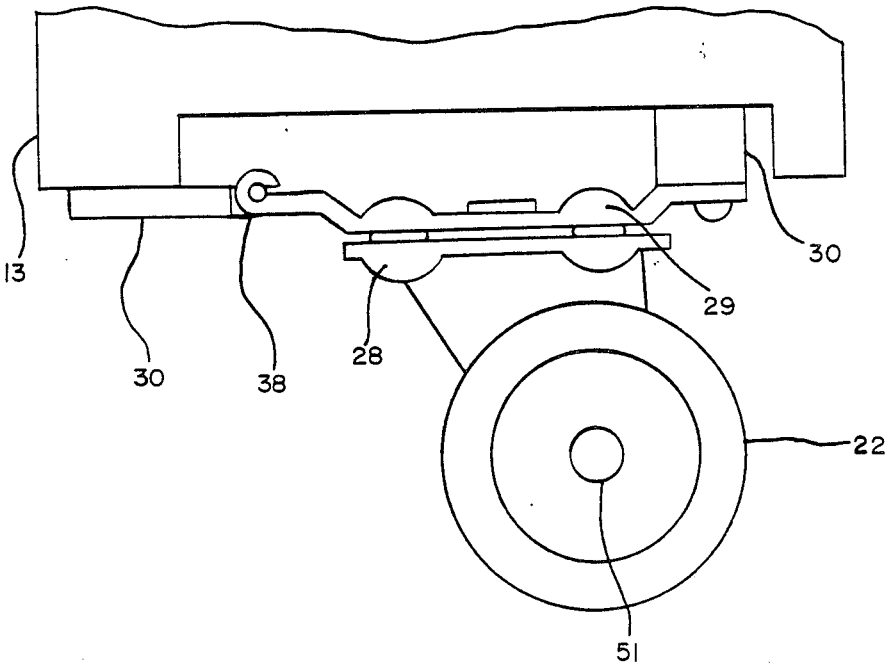
FIG. 4D is a side view of an outer platform pivoting roller.
Figure 4E:
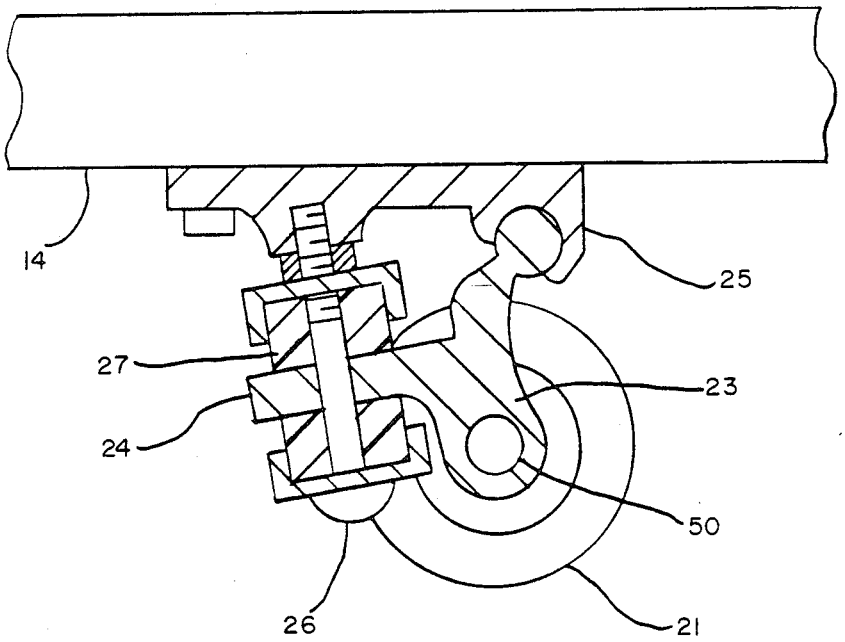
FIG. 4E is a cross sectional view of an inner platform turning roller assembly.

Referring to FIGS. 4D and 4E, there are two types of rollers on this device with different functions of maneuvering. Each roller type is arranged in a set of at least a front and rear pair of rollers such that the turning rollers 21 are on the inner platform 14 and the pivoting rollers 22 are on outer frame 13. The use of axle ball bearings in both roller types is desirable.

The pivoting rollers 22 are always in contact with the ground and are free to rotate to align with the direction of force exerted on the ski while the user is turning or sliding the ski. Thus, the pivoting rollers 22 impart a sliding characteristic to the ski that permits the ski 10 to skid during a turn, sideslip downhill and pivot. These aspects of motion are quite similar to those occurring in snow skiing, and likewise they are controllable with the use of the turning rollers 21 to limit sliding of the ski 10 as accomplished with the edge of a snow ski. The pivoting roller 22 is attached to a caster 28 and rotates around a horizontal axis 51. In turn, the base plate 29 of the caster 28 is mounted to the underside of the frame 13 inner platform 14 such that the base plate is allowed to recess to an acute angle into a compressible pad 30. The compressible pad 30 may be formed of any elastomeric material such as a foam rubber. The front edge of the base plate 29 is attached to a hinge 31 having a transverse horizontal axis 38 about which the base plate can rotate. Consequently, when weight is applied to the ski, the base plate 29 and caster 28 rotate about the transverse axis 38. Therefore, the pivoting roller is biased in the longitudinal direction of the ski 10 relative to the force exerted by the skier when weighting the ski. The object of this biasing is to induce tracking of the ski in a manner similar to that experienced with a conventional snow ski, which has the tendency to travel along a linear path when the skier applies weight to a ski resting horizontally on the surface. Thus, linear tracking can be enhanced while the ski travels in a traverse or downhill direction.

The turning rollers 21 allow the user to turn the ski by tilting the inner platform. The turning roller 21 may be identical to the commercially available type commonly used in skateboards. The turning rollers are arranged such that they do not descend as far down from platform 14 as the pivoting rollers 22 descend from the frame 13. Therefore, when the platform 14 and frame 13 are substantially co-planar, the turning rollers 21 will not contact the ground. Utilizing conventional skateboard rollers, the roller assembly 17, 18 has an axle mount 23 with a transverse axis 50 to which the roller 21 is attached. A flexible connection is made between the collar 24 attached to the axle mount 23 and the base plate 25 with a bolt 26 housed in a rubber sleeve 27. The bolt 26 is positioned at an acute angle with respect to the base plate 25. The turning roller assemblies 17, 18 provide limited pivotal movement of the rollers 21 when the inner platform 14 is tilted. The resultant maneuvering provided by such an arrangement is almost identical to that experienced while turning a snow ski which is on its edge and not sliding.

Figure 6:
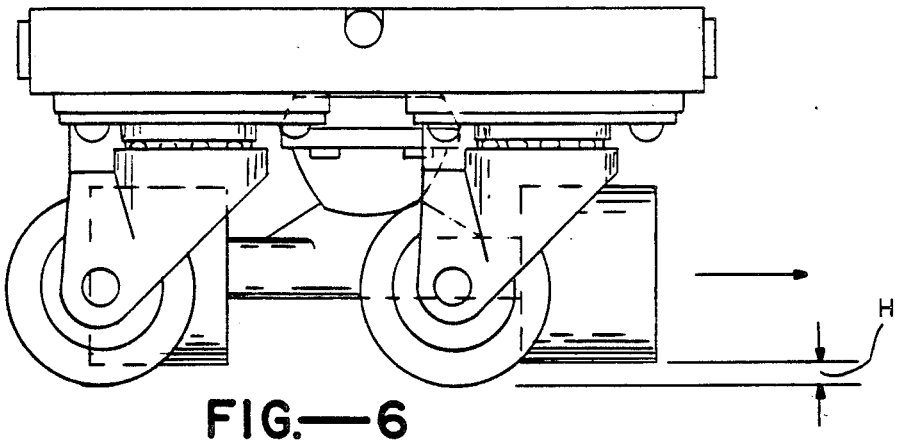
FIG. 6 is an rear view of the ski shown in FIG. 1 displaying the roller orientation that prevails when executing a slideslip.
Figure 5:
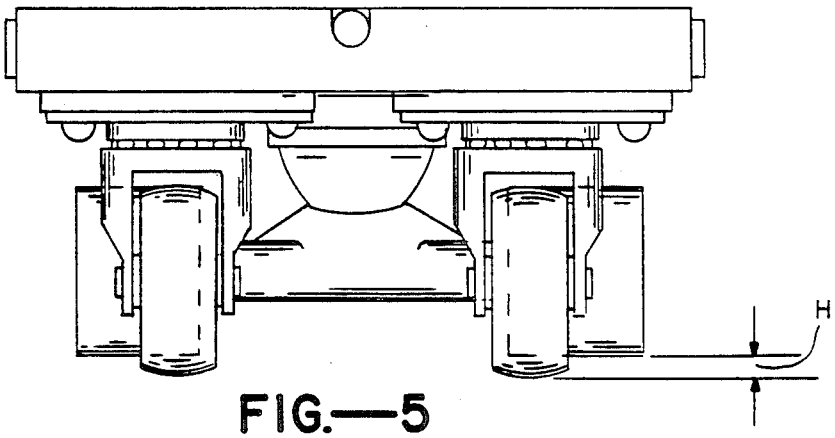
FIG. 5 is an rear view of the ski shown in FIG. 1 displaying the roller orientation that prevails when skiing downhill with each ski weighted equally.
Figure 7:
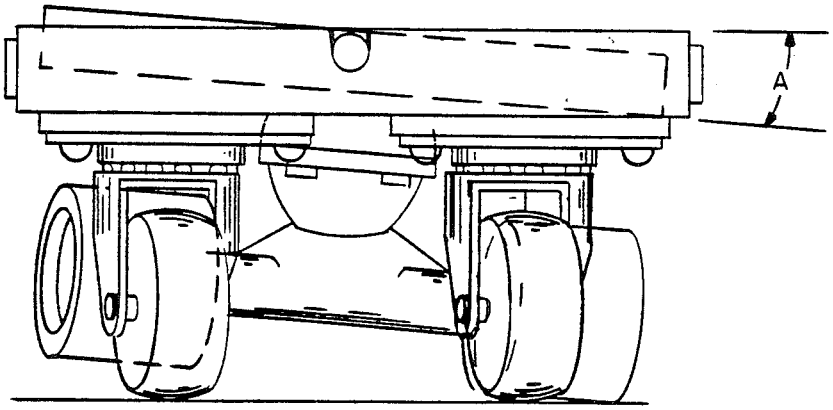
FIG. 7 is an rear view of the ski shown in FIG. 1 displaying the roller orientation that prevails when executing a turn to the skier's right.

In accordance with this invention, as shown in FIGS. 5 through 7, the turning and sliding aspects of motion are performed on two sets of rollers 21, 22 that are differentially spaced by a distance "H" when the horizontal surfaces of the outer frame 13 and inner platform are parallel. Upon tilting the inner platform 14 by an angle "A" about the longitudinal axis of the ski (at support rod 19), the user maneuvers the turning rollers 21 on one side of the inner platform to contact the ski surface. The force exerted on the turning rollers 21 by the skier while tilting the platform 14 causes the rollers 21 to make contact with the ground (on one side of the platform 14) and turn the ski. Thus, the ski 10 is allowed to track along a curving path of travel. The contact of the rollers 21 with the surface can also be used to reduce lateral sliding (that occurs during a turn) or downhill sliding. For example, a downhill sideslip on the pivoting rollers 22 will be reduced or stopped completely by engaging the turning rollers with the ground by pivoting the inner platform about the axis of the support rod 19. In contrast to permit the ski to slide, the user disengages the turning rollers 21 from the surface thereupon distributing all or the majority of his weight on the pivoting rollers 22 rather than the turning rollers 21.

To maneuver on the roller ski described herein, the user makes body movements nearly identical to those which he would make in conventional downhill snow skiing. These maneuvers include weighting, edging (or tilting of the ski), pivoting and sideslipping. A discussion of these motional aspects will explain the operation of the ski.

Figure 8:
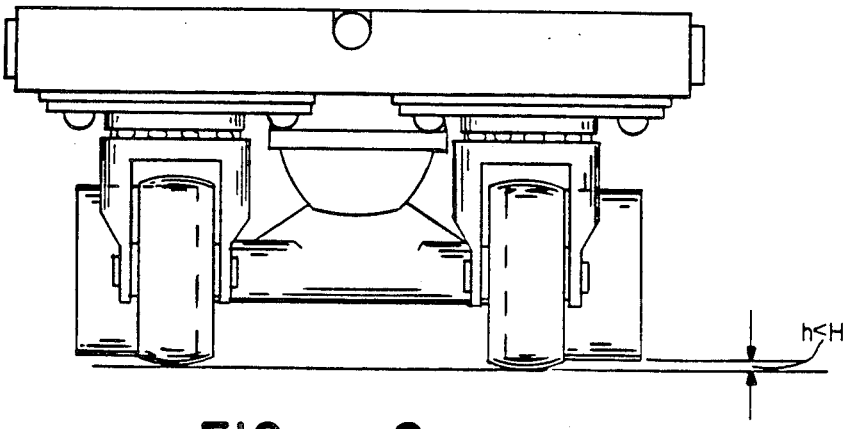
FIG. 8 is an rear view of the ski shown in FIG. 1 taking the orientation that prevails when being worn as a right ski with more weight being applied to the right ski than the left ski.

Weighting involves distributing the skier's weight unevenly on a pair of skis and thus permits the skier to place more weight on the downhill ski to either effect a turn when tilting the ski to an edge or track along a linear path across or down a slope of travel. Turning is accomplished on the turning rollers 21 that are functionally dependent on weight and the degree of tilting of the ski 10. Tracking along a linear path is enhanced by weighting also. More weight applied to either one of a pair of skis 10 will cause the base plate 29 of a pivoting roller 22 to recess as illustrated in FIG. 8. The roller 22 is allowed to recess into the outer frame 13 no more than one-fourth of an inch per inch in diameter of the roller 22. As a result, the pivoting roller 22 is less likely to deviate from a longitudinal direction of the ski 10.

Turning is executed by tilting or pivoting the ski 10. As shown in FIG. 7, the turning rollers 21 allow the ski 10 to turn along a path of an arc when these rollers are engaged with the ski surface. Pivoting of a downhill ski, on the other hand, involves sliding and is thus permitted with the ski 10 when the turning rollers 21 are not substantially weighted to interfere with the rotation of the pivoting rollers 22. Pivoting is a very important part of a conventional snow ski turn because the ski is allowed to change course when the skier initiates a turn in a different direction. Besides permitting a ski to pivot, sliding allows the ski 10 to move laterally during a turn and sideslip. Sideslipping is accomplished by substantially weighting the pivoting rollers 22 and not engaging the turning rollers with the ski surface to a degree that will cause the pivoting rollers to track in line with the turning rollers as illustrated in FIG. 6.

To simulate the forward motion that a skier exerts to make the front portion of a conventional ski edge engage the ski surface while allowing the rear portion to slide during a turn, the transverse fastening plates 20 (in which the support rod 19 is housed) may recess onto compressible rings 32 that are attached to adjustable screws 35 controlling the maximum vertical displacement of the support rod 19 within the longitudinal groove 33 as shown in FIGS. 4A, 4B and 4C. Alternatively, the fastening plates 20 may recess onto a pair of compressible beds on the left and right sides of the support rod 19 so as to disallow lateral movement of the support rod which involves the attachment of the plates 20 to the outer frame 13 in a manner that allows only vertical displacement of the plates 20. This feature permits the forward and rear turning rollers 21 to differentially engage the ski surface. For example, if the skier pressed against the tongue of the ski boot and tilts the inner platform 14, which in turn causes the front turning roller on one side of the ski to make contact with the surface while allowing the back turning roller on the same side of the ski to partially disengage from the surface, a turn may be executed by pivoting the ski and sliding the back portion of the ski in a manner similar to that performed on snow with a conventional snow ski.

Figure 1:
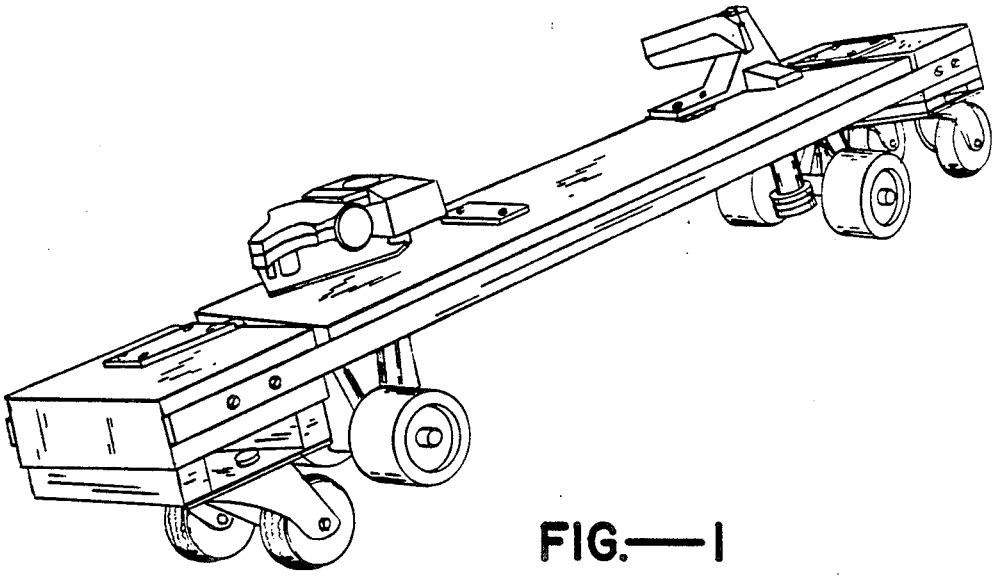
FIG. 1 is a perspective view of a pair of skis constructed in accordance with the present invention.
Figure 9:
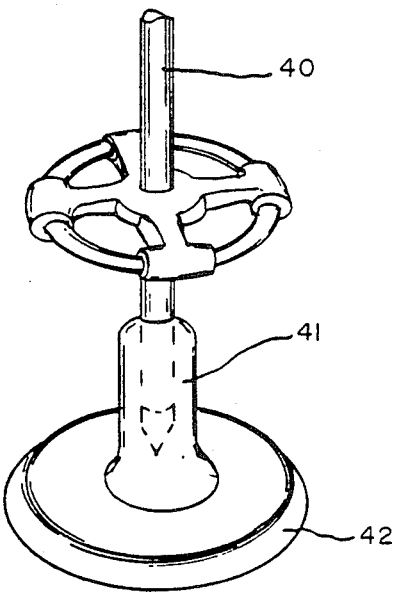
FIG. 9 is a perspective view of the tip of a ski pole suitable for use with the present invention.

Ski poles are very suitable for use with the skis of the present invention. Snow ski poles are modified as illustrated in FIG. 9 for engaging a hard smooth surface such as cement pavement. The tip of a conventional ski pole 40 is inserted into a housing 41 connected to a sole 42, a suction-like cup that flattens when pressed against the surface. Conversely on a blacktop surface, the metal tip of the snow ski pole penetrates well enough into surface to allow the use of poles without modification.

Figure 10:
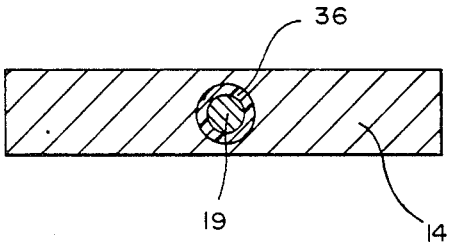
FIG. 10 is a front view of the inner platform of the ski showing an alternative embodiment of the present invention.
Figure 2:
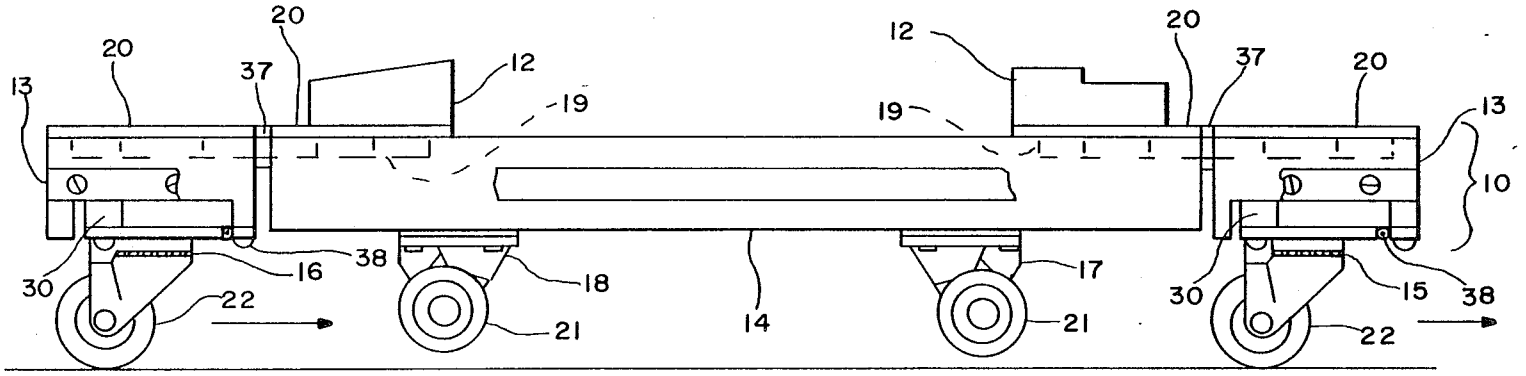
FIG. 2 is a side elevational view of one ski shown in FIG. 1.
Figure 3:
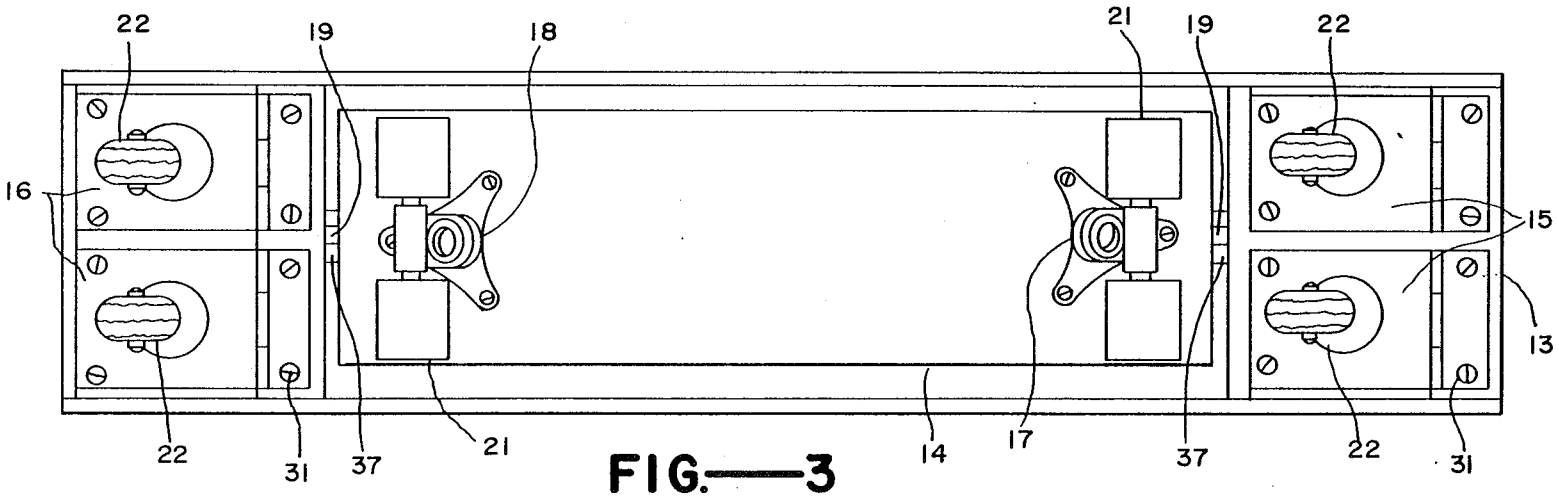
FIG. 3 is a bottom view of the ski shown in FIG. 2.

Although only one embodiment of the invention has been described in detail, it should be understood that the present invention may be embodied in many other specific forms without departing from the spirit or scope of the invention. One modification could be to remove the left and right hand side connecting ribs of the outer frame 13 to decrease the width of the ski 10. FIGS. 4A and 4B illustrate a method of connecting the support rod 19 to the outer frame 13 and inner platform 14 so that they cannot disengage. Furthermore, the support rod could run the entire length of the inner platform 14 and be housed in a bushing 36 embedded into the inner platform 14 as shown in FIG. 10. In addition, the turning and pivoting rollers 21, 22 could be spherically shaped or tapered and made of a hard plastic-like material to change the sliding characteristics of both roller types 21, 22. Another consideration is to combine the inner platform 14 and ski boot into one component of the ski without release bindings to permit shorter construction and a skate-like appearance. Therefore, the present examples and embodiments are to be considered as illustrative and not restrictive, and the invention is not to be limited to the details given herein, but may be modified within the scope of the appended claims.

In using the invention, a skier may execute the maneuvers to accomplish skiing in a snow plow or parallel positioning of the skis. Also in keeping with the invention, a skier may practice independent maneuvering of the skis since one ski is attached to each foot of the user. Consequently, the roller ski of the present invention operates in a manner that is virtually identical to that of a conventional downhill snow ski. All in all, the once seasonal sport of snow skiing can now be performed throughout the year on the present device that simulates the sliding, pivoting, turning and weighting characteristics of a snow ski.

I claim:

1. A roller ski for simulating the balance and motion of a conventional snow ski while skiing on a ground surface, the roller ski comprising:

a platform having a longitudinal axis;

a binding mounted on the platform for securing a skier's foot to the ski;

a frame having a longitudinal axis substantially aligned with the longitudinal axis of the platform, a front portion disposed in front of the binding and a rear portion disposed behind the binding;

a support rod for pivotally coupling the platform to the frame, the support rod disposed along the aligned longitudinal axes of the platform and frame, said support rod having distal and proximal ends;

a multiplicity of pivoting rollers for engaging the ground surface, the rollers being pivotally mounted to a bottom surface of the frame and arranged about the binding with a first pair of side-by-side rollers being attached to the front portion of the frame and a second pair of side-by-side rollers being attached to the rear portion of the frame to provide a stable support during use; and a turning wheel mounted to a bottom surface of the platform, the turning wheel being sized such that the turning wheel does not contact the ground surface when the frame and the platform are substantially co-planar, whereby the skier can pivot the platform relative to the frame about the support rod to cause the turning wheel to contact the ground surface by shifting body weight.

2. A roller ski as recited in claim 1 further comprising a first longitudinal groove recessed into the frame along the longitudinal axis of the frame and a second longitudinal groove recessed into the platform along the longitudinal axis of the platform, the support rod being disposed within said longitudinal grooves.

3. A roller ski as recited in claim 1 further comprising a plurality of compressible support pads recessed into the bottom side of the frame each said support pad mounting a particular one of the pivot wheels to the frame, each said compressible support pad having an associated hinge means that constrains its associated pivot wheel to compress the support pad in a manner that causes said associated pivot wheel to rotate about an axis transverse to said longitudinal axis of the frame.

4. A roller ski as recited in claim 3 wherein said pivoting rollers are mounted at an acute angle in the vertical plane relative to the longitudinal axis of the frame in order to enhance tracking.

5. A roller ski as recited in claim 4 wherein the support pads are compressed by the pivoting roller as weight is applied to said pivoting roller.

6. A roller ski as recited in claim 1 wherein the platform is disposed between a first frame portion located distally of the platform and a second frame portion located proximally of the platform.

7. A roller ski as recited in claim 6 wherein a first one of the pivoting rollers is disposed on said first frame portion and a second one of the pivoting rollers is disposed proximally of the rollers.

8. A roller ski as recited in claim 1 wherein said binding means includes a releasable binding that holds the skier's foot in place during normal skiing.

9. A roller ski for use in pairs to simulate the balance and motion of a conventional snow ski while skiing on a ground surface, the roller ski comprising:

a frame having a longitudinal center axis, a front portion and a rear portion;

a platform having a longitudinal center axis that is substantially aligned with the longitudinal axis of the frame, the platform being pivotally mounted to the frame about the aligned axes;

binding means mounted to the platform for engaging a foot of a skier;

a plurality of turning wheels attached to a bottom surface of the platform;

a plurality of pivoting rollers attached to a bottom surface of the frame for engaging the ground surface, the pivoting rollers being sized such that they extend below the turning wheels when the platform and frame are substantially co-planar and arranged with a pair of side-by-side rollers being attached to the front portion of the frame and a second pair of side-by-side rollers being attached to the rear portion of the frame;

whereby a skier can bring at least one of the turning rollers into contact with the ground surface by shifting body weight.

10. A roller ski as recited in claim 9 further comprising a support rod for pivotably connecting the platform to the frame, the support rod being disposed along the longitudinal center axes of said platform and said frame.

11. A roller ski as recited in claim 7 wherein the plurality of turning rollers includes two pairs of side by side rollers, each side by side roller pair having a first roller member extending on a first side of the platform's longitudinal axis and a second roller member extending on a second side of the platform's longitudinal axis.

12. A roller ski as recited in claim 9 wherein the frame circumscribes the platform.

* * * * *